US008618444B2

(12) United States Patent
Jones

(10) Patent No.: US 8,618,444 B2
(45) Date of Patent: Dec. 31, 2013

(54) ROTARY DOOR HEATER SYSTEM

(75) Inventor: Thaddeus M. Jones, Bremen, IN (US)

(73) Assignee: MSX Incorporated, South Bend, IN (US)

( * ) Notice: Subject to any disclaimer, the term of this patent is extended or adjusted under 35 U.S.C. 154(b) by 2339 days.

(21) Appl. No.: 11/453,402

(22) Filed: Jun. 15, 2006

(65) Prior Publication Data

US 2008/0017626 A1 Jan. 24, 2008

(51) Int. Cl.
*H05B 3/00* (2006.01)
*H05B 3/06* (2006.01)

(52) U.S. Cl.
USPC ..... 219/213; 219/520

(58) Field of Classification Search
USPC ..... 219/213, 520, 525
See application file for complete search history.

(56) References Cited

U.S. PATENT DOCUMENTS 3,823,304 A * 7/1974 Siemianowski ..... 219/213
4,990,744 A * 2/1991 Willner ..... 219/213
5,291,714 A * 3/1994 Wright et al. ..... 52/664

* cited by examiner

*Primary Examiner* — Sang Paik
(74) *Attorney, Agent, or Firm* — Taylor IP, P.C.

(57) ABSTRACT

A revolving door deicer/dryer system including a floor grate having a bottom side and a heating system associated with the bottom side of the floor grate. The heating system includes at least one shaped plate and at least one heating element serpentinely routed on the at least one shaped plate.

16 Claims, 7 Drawing Sheets

ROTARY DOOR HEATER SYSTEM

BACKGROUND OF THE INVENTION

1. Field of the invention

The present invention relates to a rotary door floor heating system, and, more particularly, to a rotary door floor deicing and drying system.

2. Description of the Related Art

Under floor heating systems date back thousands of years including Roman and Korean heating system where stone slabs are installed on an upper part of flues in a hypocaust connected with a fuel feeding port and a chimney. A burning fuel, such as wood or coal is burnt thereby heating the floor from the underneath side. The problem with this system is that a lot of thermal energy is drawn off by way of the fuel feeding hole and the chimney when a fire is not kindled therein. Some modern floor heating systems include the circulation of a heated thermal medium fluid through long, thin seamless pipes disposed beneath a floor. A floor heating system that involves the circulation of a thermal medium fluid has a portion of a floor that is heated to a higher temperature than a portion of the floor associated with the end of the circulation path. For example, the temperature of the heated thermal medium as it circulates gradually decreases in temperature causing the portion that is first heated to be heated to a higher temperature than the area of the floor associated with the end of the circulation path.

Building entryways often have grate systems for the dissipation of water that is tracked in by pedestrian traffic. Grate systems often have a channel for the diverting of moisture to a drain that is located beneath the grid system. Grid systems are often located in an exterior environment, such as with a rotary door having a sector of the floor grid being exposed to the outer ambient environment. The temperature of the outer environment may be below freezing, which can result in a buildup of ice on the exposed exterior portion of the floor. Another problem with rotary doors is that moisture is tracked from the entrance sector to adjacent sectors, which can result in a transition from ice or snow to melted water. The problem with water on floor grates of rotary door systems is that the grate system is made of a resilient material, such as metal and the presence of ice and/or moisture thereon can cause the surface to have a reduced frictional characteristic.

What is needed in the art is a simple to install system for the deicing and drying of entrance door floor grates.

SUMMARY OF THE INVENTION

The present invention provides a modular installation system for heating rotary door floor grates.

The invention comprises, in one form thereof, a revolving door deicer/dryer system including a floor grate having a bottom side and a heating system associated with the bottom side of the floor grate. The heating system includes at least one shaped plate and at least one heating element serpentinely routed on the at least one shaped plate.

An advantage of the present invention is that the heating system is inserted underneath a sector of a floor grate from a rotary door system.

Another advantage of the present invention is that the presence of ice and/or moisture is sensed and controlled, and the drain is heated by heating elements that extend thereinto.

Another advantage of the present invention is that power is supplied to the heated floor sector by way of existing plumbing that serves as a drain for the subfloor beneath the rotary door grate system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
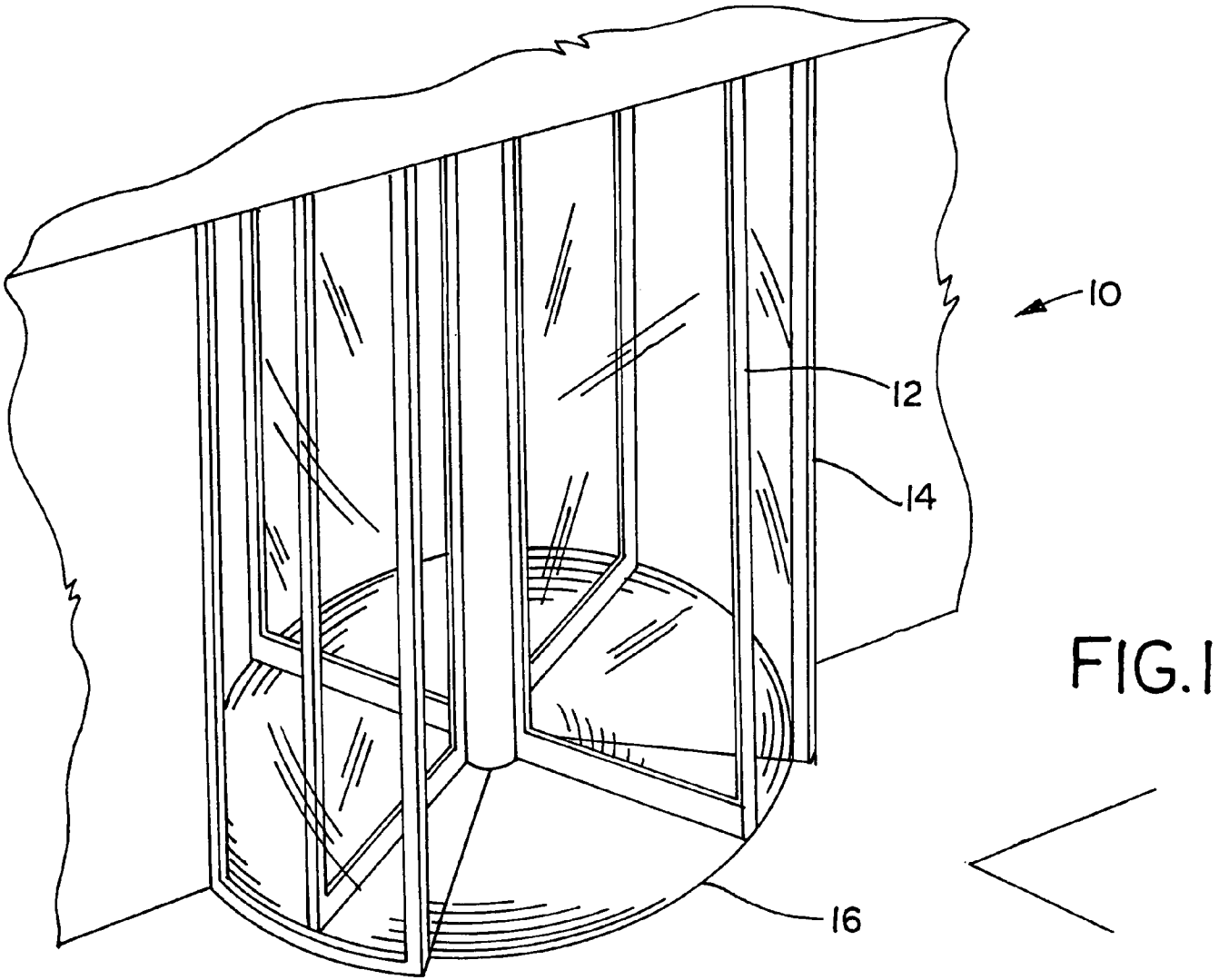
FIG. 1 is a perspective view of a rotary door system including floor grates heated by an embodiment of the present invention.
Figure 2:
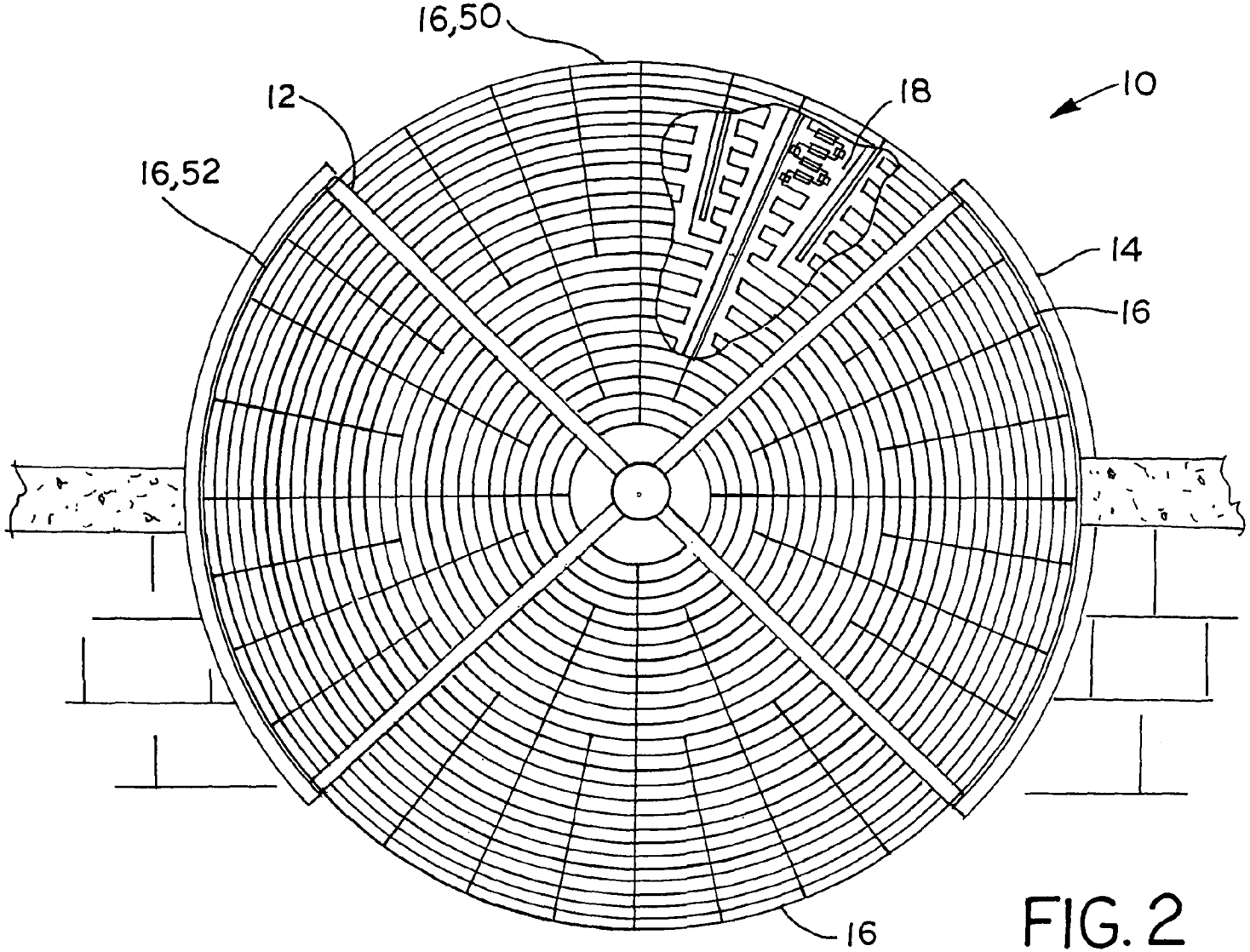
FIG. 2 is a top view of the rotary door system of FIG. 1, showing a cutaway with the heating system of the present invention being illustrated thereunder.

Referring now to the drawings, and more particularly to FIGS. 1 and 2, there is illustrated a rotary door system 10 including a rotary door 12, an enclosure 14, floor grates 16 and an ice melting/drying system 18. Rotary door system 10 provides a quasi-air-lock system for entry into a building. A substantially cylindrical enclosure 14 extends a circumferential distance, that precludes a direct airway between the interior and the exterior of the building, as door 12 rotates. Door 12 rotates in a particular direction, normally counter-clockwise when viewed from above. A person enters an outer portion of rotary door system 10 and normally proceeds to the right causing door 12 to rotate counter-clockwise and allows the person to enter by way of the rotating sector of space in which the individual is temporarily enclosed.

Figure 3:
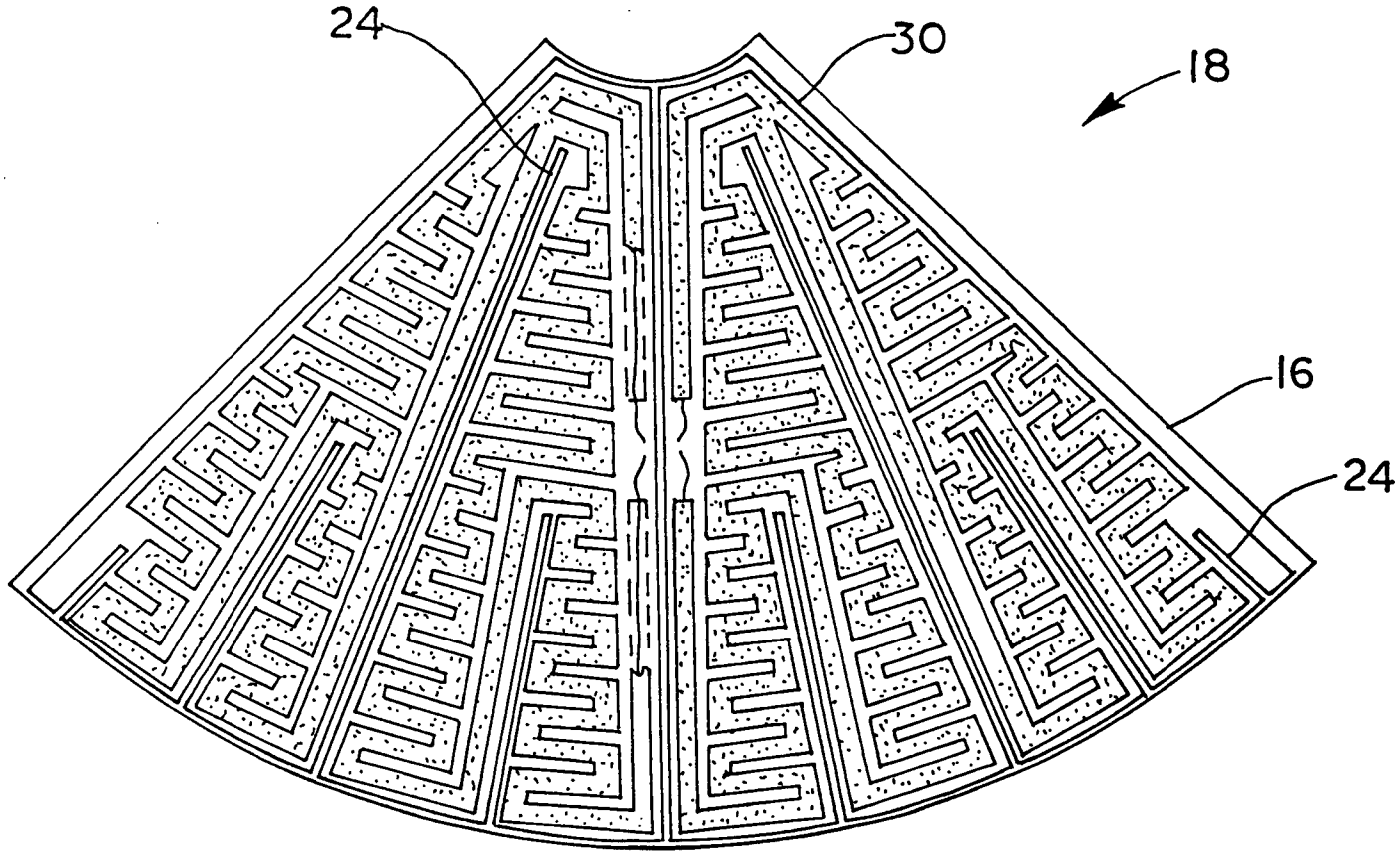
FIG. 3 is an underneath view of a floor grate sector of FIGS. 1 and 2 showing the modular heating elements installed thereon.
Figure 4:
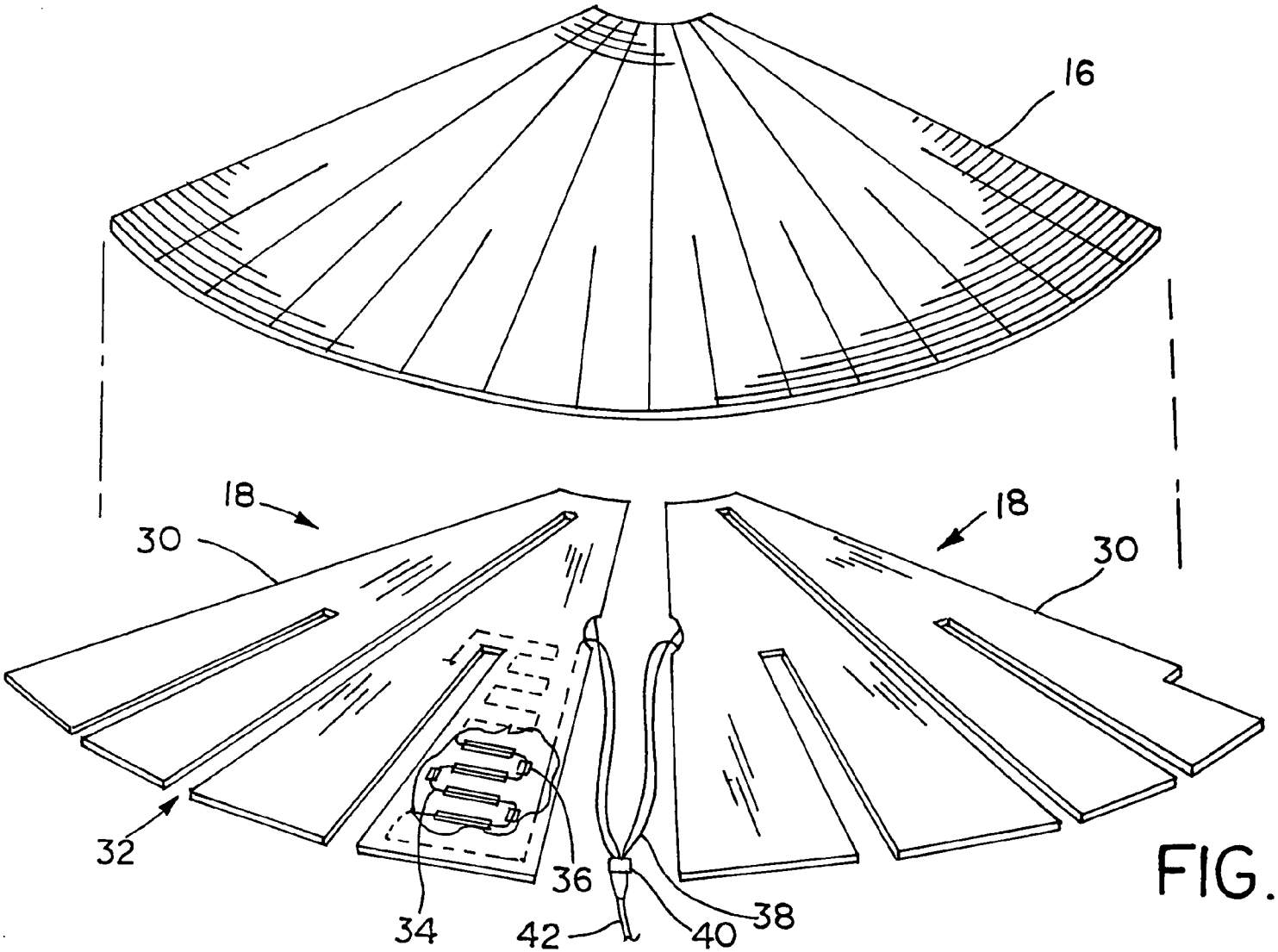
FIG. 4 is an exploded view of a floor grate heating system of FIGS. 1-3.
Figure 5:
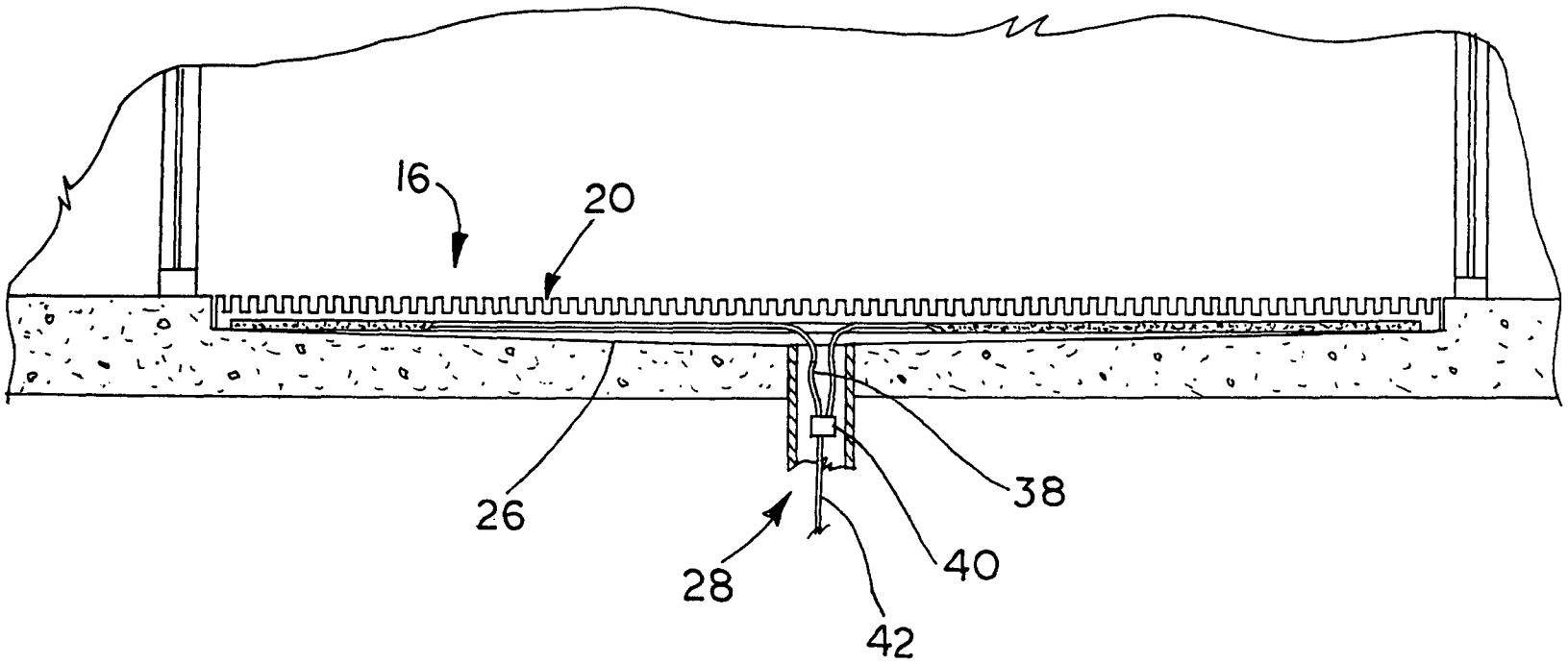
FIG. 5 is a cross-sectional view of the heated floor grate of FIGS. 1-4.
Figure 6:
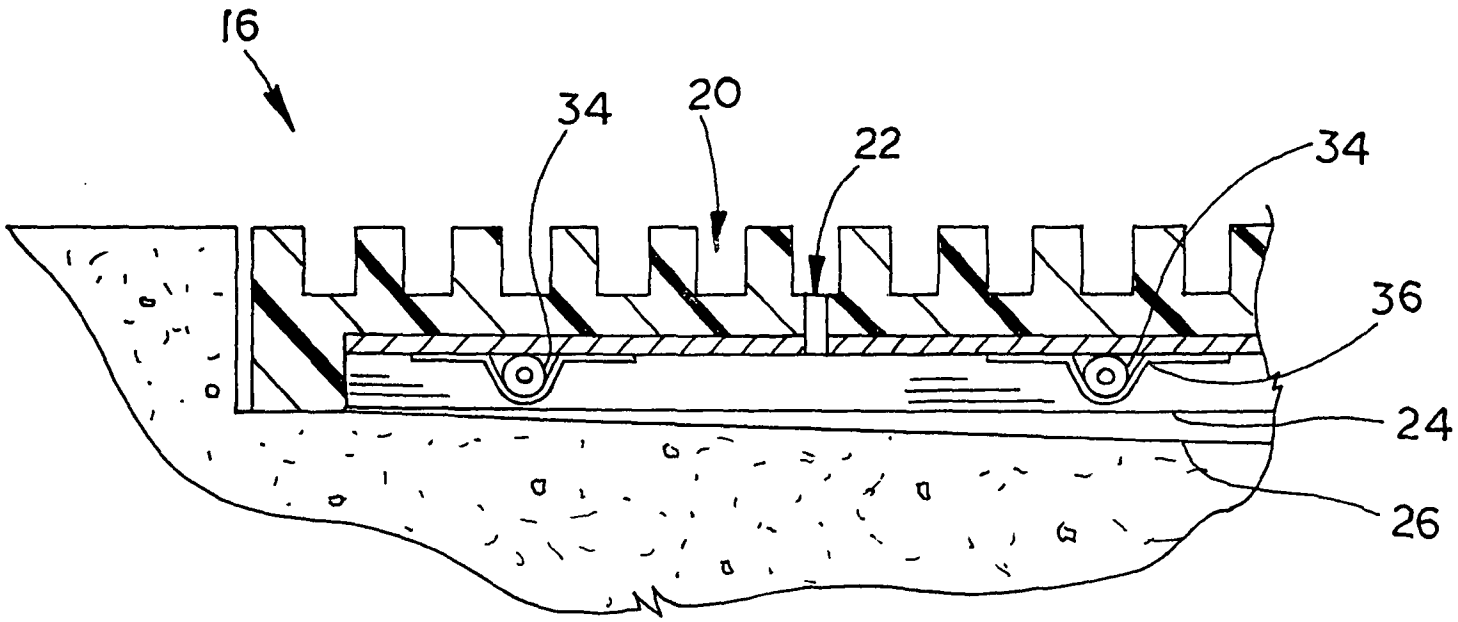
FIG. 6 is an enlarged cross-sectional view of a portion of the floor grate heating system of FIGS. 1-5.

Now, additionally referring to FIGS. 3-7, floor grates 16 include channels 20, drain holes 22 and support fins 24. Floor grates 16 are generally shaped as shown in FIGS. 3 and 4 to extend over approximately one quadrant of the floor so as to allow a single floor grate 16 to be lifted up for maintenance purposes, while door 12 is positioned to allow the removal of the appropriate sector. Channels 20 on a top surface of grate 16 allow for the flow of water that is melted to travel to drain holes 22 allowing the water to drain through the surface of floor grates 16 and for its eventual removal from the system. Support fins 24 extend from a bottom surface of floor grate 16 to provide rigidity for grates 16 and to contact with portions of subfloor 26. Support fins 24 while providing rigidity for grates 16, introduces obstacles, which the present invention works around in order to provide heat to floor grate 16. Subfloor 26 additionally has a floor drain 28 for the removal of water that drains through floor grate 16.

Ice melting/drying system 18 includes plates 30 having slots 32 therein. System 18 additionally includes heater conductors 34, tape 36, heated leads 38, an electrical connection 40, conductors 42, a sensor 44, sensor conductors 46 and a controller 48. Plates 30 have slots 32, which accommodate support fins 28 of grates 16. Slots 32 allow for plate 30 to be seated against a surface of the underneath side of grate 16 to allow the conduction of heat into grates 16. In the example shown in FIGS. 3 and 4 two plates 30 each having slots 32 are used to provide heat to one floor grate sector 16. Heater conductors 34 are routed upon a surface of plate 30 in a serpentine manner and are covered with heating tape 36, which may be in the form of a metallic adhesive tape that bonds well with plate 30. At an end of the conduction paths of heater conductors 34, heater conductors 34 extend away from plate 30 and be electrically connected at electrical connection 40. The extension of heater conductors 34 is shown and identified as heated leads 38 that extend into drain 28. This advantageously provides heat in drain 28 to prevent the accumulation of ice therein. At some point along heater leads 38 electrical connection 40 is utilized to connect heated conductors 34 and heated leads 38, which are arranged in a serial electrical connection to power supplying conductors 42. Conductors 42 extend back to controller 48, which supplies power to heater conductors 34 and heated leads 38.

Figure 7:
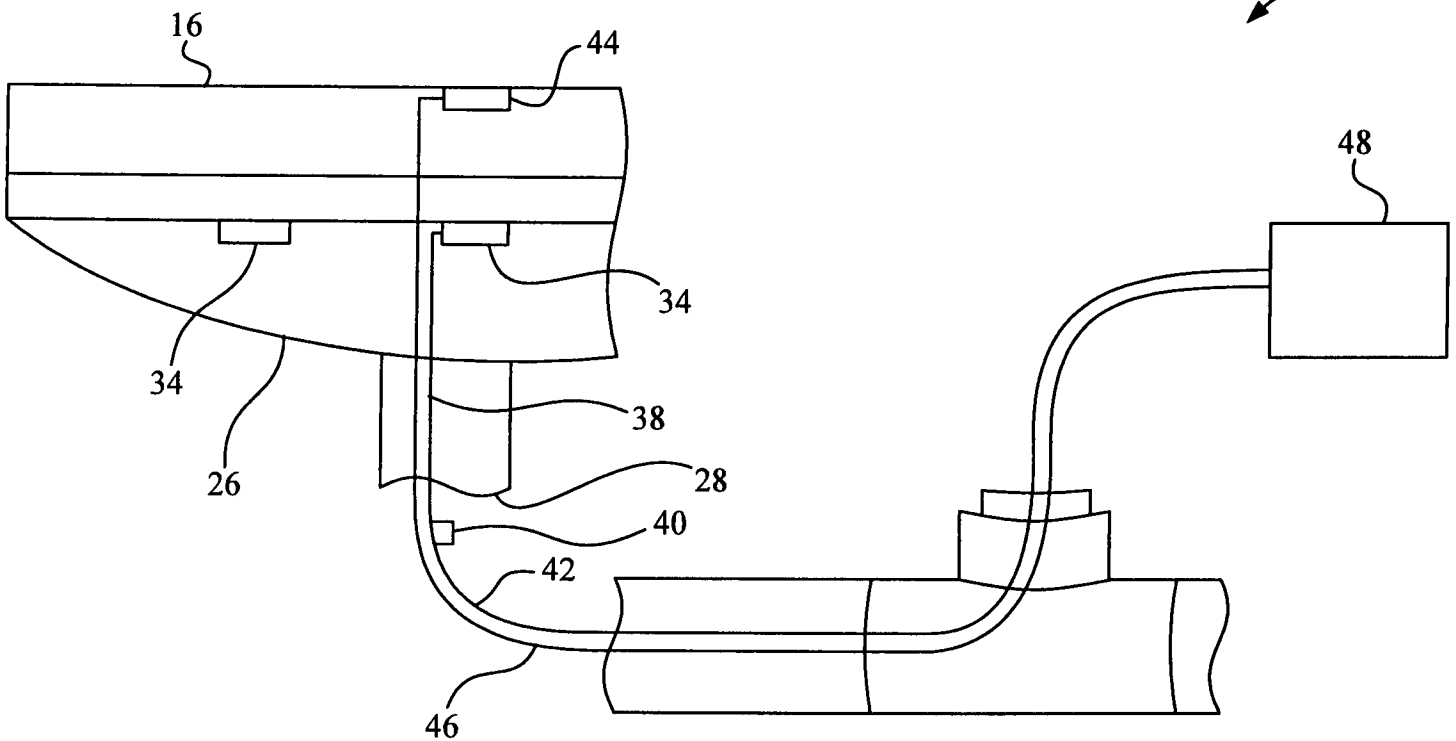
FIG. 7 is a schematical representation of the floor grate heating system of FIGS. 1-6.

A sensor 44 detects the presence of moisture which may be liquid or frozen and provides information by way of sensor conductors 46 to controller 48. While what is shown in FIG. 7 is one sensor 44 it can be understood that each flooring grate 16 may include at least one sensor 44. Information regarding the presence of moisture on grating 16 causes controller 48 to provide power to heating conductors 34 and heated leads 38.

Since floor grating 16 should provide a safe dry surface for pedestrians the mere melting of snow may be insufficient and a drying operation is needed to remove the moisture from grates 16. Although it can be understood that sensor 44 may be a temperature sensor the mere heating of floor grate 16 when it is cold may not be necessary if moisture is not present. While the control system can be utilized to simply heat floor grating 16 based on the temperature thereof sensor 44 detects moisture on grates 16. As shown in FIG. 7, conductors 42 and sensor conductors 46 are routed through existing plumbing fixtures, which provides two advantages. One advantage is that no other wire routing system is necessary. Another advantage is that heated leads 38 prevent a buildup of frozen water in drain pipe 28.

Often doors 12 are restrained to rotate in one direction, which advantageously allows the installation of ice melting/drying system 18 in a first grate 50, which is located on an exterior side of door 12. One adjacent sector grate 52 may additionally be heated in the event that moisture may be carried from grate 50 onto grate 52. Advantageously the present invention allows the installer to decide how many grates 16 the present invention is applied to based on the likely exposure of rotary door system 10 to moisture.

In the event that door system 10 is in a busy portion of a building the present invention allows for the easy removal/installation of melting/drying system 18 to and from grates 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A revolving door floor deicer/dryer system, comprising:
a floor grate having a bottom side, said floor grate having at least one support fin extending from said bottom side;
a heating system associated with said bottom side, said heating system including:
at least one shaped plate; and
at least one heating element serpentinely routed on and adhered to said at least one shaped plate, said at least one shaped plate having at least one slot therein, said at least one support fin extending through a portion of said at least one slot.

2. The system of claim 1, further comprising:
a support structure beneath said floor grate;
a drain extending from said support structure; and
at least one heated lead routed down said drain.

3. The system of claim 2, wherein said at least one heated lead is electrically connected to said at least one heating element.

4. The system of claim 3, wherein said at least one heated lead is electrically connected in series with said at least one heating element.

5. The system of claim 4, further comprising a control system controllably supplying power to said at least one heating element by way of said at least one heated lead.

6. The system of claim 1, wherein said heating element is between said floor grate and said shaped plate.

7. The system of claim 6, wherein said at least one shaped plate has an outer perimeter having a sector shape.

8. The system of claim 7, wherein said floor grate includes a plurality of sections, said plurality of sections including an entrance section, said heating system being associated with said entrance section.

9. The system of claim 8, wherein said plurality of sections additionally includes a subsequent section to said entrance section, said subsequent section being located adjacent to said entrance section in a direction in which the revolving door rotates, said heating system being additionally associated with said subsequent section.

10. A floor grate deicer/dryer system associated with a rotating door, the floor grate having a perimeter and at least one support fin extending from a bottom side thereof, the at least one support fin being located away from the perimeter, the floor grate deicer/dryer system, comprising:
a heating system associated with a bottom side of the floor grate, said heating system including:
at least one shaped plate; and
at least one heating element serpentinely routed on and adhered to said at least one shaped plate, said at least one shaped plate having at least one slot therein, the at least one support fin extending through a portion of said at least one slot.

11. The system of claim 10, further comprising at least one heated lead extending from said at least one heating element, said at least one heated lead configured to be routed down a drain beneath the floor grate.

12. The system of claim 11, wherein said at least one heated lead is electrically connected to said at least one heating element.

13. The system of claim 12, wherein said at least one heated lead is electrically connected in series with said at least one heating element.

14. The system of claim 13, further comprising a control system controllably supplying power to said at least one heating element by way of said at least one heated lead.

15. The system of claim 10, wherein said heating element is between said floor grate and said shaped plate.

16. The system of claim 15, wherein said at least one shaped plate has an outer perimeter having a sector shape.

* * * * *